United States Patent [19]

Hamisch, Jr.

[11] 4,334,470

[45] Jun. 15, 1982

[54] PRINT HEAD WITH ENDLESS BANDS AND SPACER

[75] Inventor: Paul H. Hamisch, Jr., Franklin, Ohio

[73] Assignee: Monarch Marking Systems, Inc., Dayton, Ohio

[21] Appl. No.: 159,021

[22] Filed: Jun. 13, 1980

Related U.S. Application Data

[63] Continuation-in-part of Ser. No. 801,886, May 31, 1977, abandoned.

[51] Int. Cl.[3] ..... B41J 1/20

[52] U.S. Cl. ..... 101/111; 101/105

[58] Field of Search ..... 101/111, 93.14, 105; 400/146

[56] References Cited

U.S. PATENT DOCUMENTS

| | | | |
|---|---|---|---|
| 1,143,445 | 6/1915 | Scotford | 101/111 |
| 2,123,952 | 7/1938 | Melind | 101/111 |
| 3,712,213 | 1/1973 | Flemino | 101/110 X |
| 3,889,594 | 6/1975 | Nicholson | 101/111 |
| 3,948,172 | 4/1976 | Jenkins | 101/316 |
| 3,968,745 | 7/1976 | Hamisch | 101/111 |
| 4,052,938 | 10/1977 | Kirby | 101/291 |
| 4,222,327 | 9/1980 | Hamisch | 101/111 X |

*Primary Examiner*—Edward M. Coven

*Attorney, Agent, or Firm*—Joseph J. Grass

[57] ABSTRACT

There is disclosed a print head for printing two lines of data. Relatively thin spacers separate adjacent drive wheels and adjacent portions of the printing bands. A relatively thick spacer is disposed adjacent sets of printing bands of at least one line so that the printing bands print two spaced-apart fields of data.

14 Claims, 12 Drawing Figures

24689
REGULAR
$10.98
24689
SALE
$8.98
2769 693 14
SKU COLOR SIZE
24 3/$8.98

PRINT HEAD WITH ENDLESS BANDS AND SPACER

CROSS-REFERENCE TO RELATED APPLICATION

This application is a continuation-in-part of pending application Ser. No. 801,886, filed May 31, 1977, abandoned.

BACKGROUND OF THE INVENTION

1. Field of the Invention

This invention relates to the art of printing.

2. Brief Description of the Prior Art

Prior art print heads are disclosed in U.S. Pat. No. 1,143,445 to Scotford issued June 15, 1915, U.S. Pat. No. 3,798,106 to Jenkins et al issued Mar. 19, 1974, U.S. Pat. No. 3,889,594 to Nicholson issued June 17, 1975, U.S. Pat. No. 3,948,172 to Hamisch, Jr. issued Apr. 6, 1976, and U.S. Pat. No. 4,052,938 to Kirby issued Oct. 11, 1977.

SUMMARY OF THE INVENTION

This invention relates to an improved print head having a spacer separating two sets of printing bands. The spacer according to one specific embodiment includes an annular portion having a hole with teeth at its inner periphery. The annular portion is disposed on a concave mounting surface between two sets of drive wheels which are cradled on the concave surface. Each drive wheel has a central hole with teeth disposed at its inner periphery. The central holes and the spacer hole are axially aligned and provide an axially extending opening. The printing bands are detented and the drive wheel teeth and the spacer teeth are in alignment when the printing bands are detented. A rotatable and shiftable selector has teeth selectably engageable with the teeth of any drive wheel to provide for advance of the selected drive wheel and the selected printing band when the selector is rotated. The teeth on the spacer provide for smooth transition as the selector teeth move from engagement with the teeth of a drive wheel of one set to a drive wheel of the adjacent set. A pair of spacer members are joined to the annular portion. The spacer is of one-piece molded plastics construction and the spacer members are flexible and resilient. The spacer members have free end portions which are spaced more closely in the unassembled state than the width of the support. When the spacer is assembled into the support, the support is clamped between the free end portions and thus the spacer is held securely in place. The spacer members have reduced thickness portions to obviate extensive contact of the spacer members with adjacent printing bands. The free end portions of the spacer member and the annular portion of the spacer are approximately equal in width to the width of a printing band. The outer surfaces of the annular portion and the free end portion are coplanar. The spacer has means cooperable with the selector for detenting the selector in a selected axial position.

DETAILED DESCRIPTION OF THE PREFERRED EMBODIMENTS

Figures 1, 2, 3, 4, 5, 6, 7:
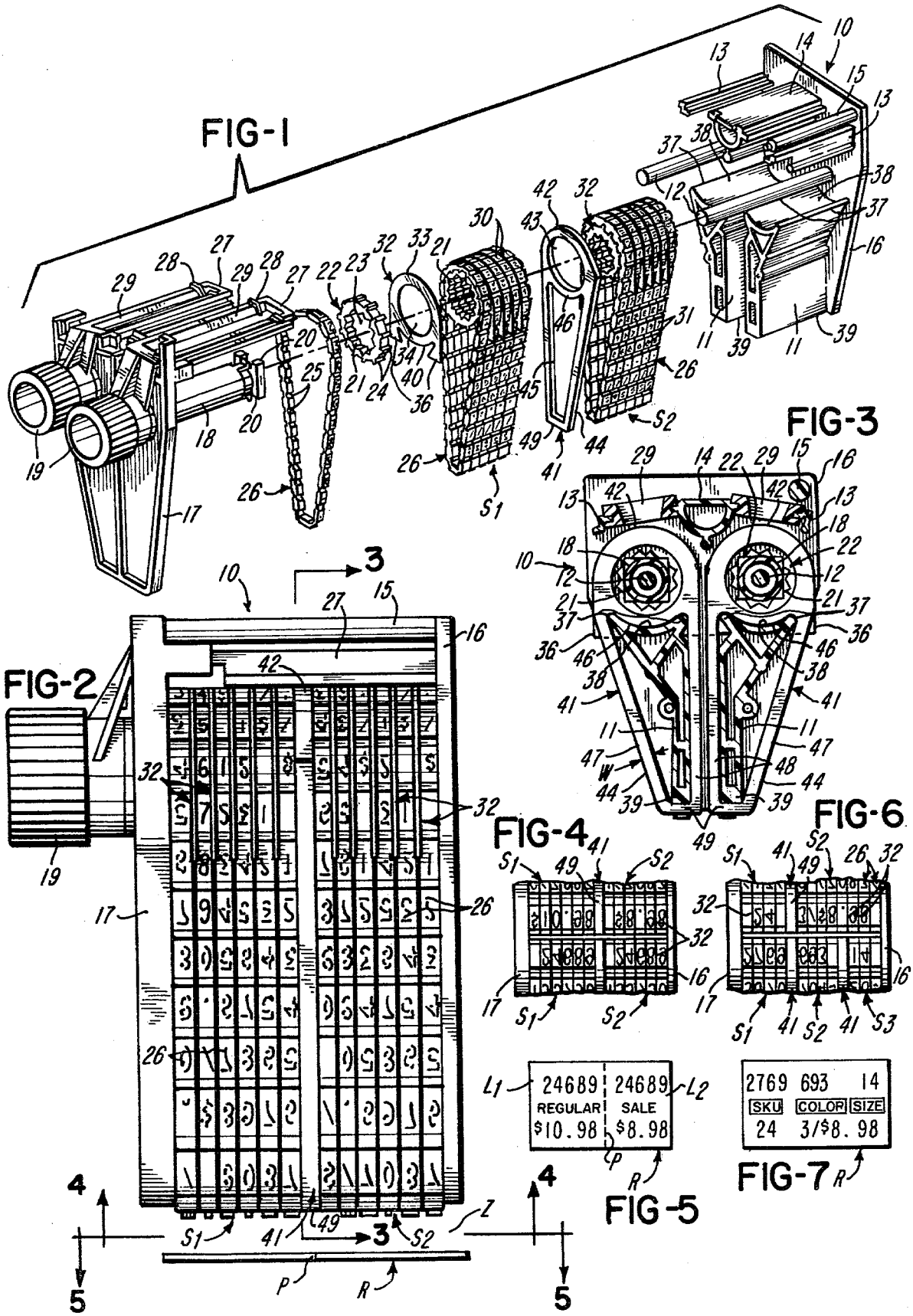
FIG. 1 is an exploded perspective view of a print head with certain parts being omitted for clarity.
FIG. 2 is an enlarged front elevational view of the print head.
FIG. 3 is a sectional view taken along line 3—3 of FIG. 2, but on a reduced scale.
FIG. 4 is a view taken along line 4—4 of FIG. 2, but on a reduced scale.
FIG. 5 is a view taken along line 5—5 of FIG. 2, but on a reduced scale.
FIG. 6 is a fragmentary bottom plan view, similar to FIG. 4, of an alternative embodiment.
FIG. 7 is a top plan view, similar to FIG. 5, of a record printed by the print head of FIG. 6.

With reference to FIG. 1, there is shown a print head body generally indicated at 10 including a pair of print head frames or supports 11, a pair of posts 12, guides 13 and 14 and a post 15 all connected to each other by an end plate 16. The print head 10 also has another end plate 17 which is suitably secured to the frames 11 and to the post 15. A pair of selectors 18 have respective knobs 19. The selectors 18 have lugs or teeth 20 which can cooperate with teeth 21 in drive wheels 22. As shown, each drive wheel 22 is of generally annular construction and has an internal hole 23 and peripheral lugs 24 which engage in corresponding notches 25 in the underside of a respective printing band 26. Rectangular members 27 having pointers 28 move as a unit with the respective selectors 18. The members 27 provide window openings 29 through which characters on human readable portions 30 of the printing bands 26 can be viewed. The printing bands 26 also include printing sections 31 having a variety of different printing characters or elements for printing data on merchandise or on a record such as a tag or label R. Additional details of the print head 10 are shown in U.S. Pat. No. 3,798,106, the disclosure of which is incorporated herein by reference.

Each line of printing bands 26 is separated into sets S1 and S2. Relatively thin spacers 32 are disposed between drive wheels 22 of each set S1 and S2. Each thin spacer 32 has an annular portion 33 having an annular through-hole 34 which is slightly larger than the hole 23 in a drive wheel 22 so that the selector can be readily shifted from cooperation with one drive sheel 22 into cooperation with another selected drive wheel 22. The spacer 32 has projections 36 which straddle portions 37 of the frame 11 as indicated in FIG. 3. Accordingly, the thin spacer 32 is incapable of rotation as the adjacent drive wheel is rotated. Moreover, rotation of any drive wheel 22 and advance of the respective printing band 26 will not cause rotation of any adjacent drive wheel 22 and consequently no adjacent printing band 26 will be advanced. The outer periphery of the spacer 32 extends outwardly beyond the outer periphery of the adjacent drive wheel 22 so that adjacent bands are separated from each other and locations adjacent the drive wheels 22. The drive wheels 22 are cradled in and supported by concave arcuate mounting portions 38 of the frames 11. The lugs 34 ride on the respective surfaces 38 as they rotate. The printing bands 26 pass around the drive wheels 22 and around the support surface 39 under tension. A relatively thick spacer generally indicated at 41 is shown to separate the sets S1 and S2 of printing bands so that the sets S1 and S2 provide two spaced-apart fields of printing on the record member R as shown in FIG. 5. It is advantageous to use the thick spacer 41 to separate the printing into two separate fields. The record R can be a label having label parts L1 and L2 in which the underside of the label part L1 had pressure sensitive adhesive. The label part L1 indicates the regular price and the label part L2 indicates the sale price. When the sale is over, the store clerk can tear off the label part L1 along the line of perforation P so that only the regular price remains on the product. If the fields on the label part L1 and L2 were not separated, the printing may overlap the line of perforation P with undesirable results due to faulty lateral registration. The separator or spacer 41 is shown to include a generally annular portion 42 having an annular through-hole or opening 43 and also a generally trapezoidal portion 44 having a generally trapezoidal through-hole or opening 45. Arcuate portion 46 is common to both the annular portion 42 and the trapezoidal portion 44. The arcuate portion 46 is received on and cradled by the surface 38. The trapezoidal portion is also composed of converging portions 47 and 48 joined by a connecting portion 49. The portion 48 extends generally tangentially to the annular portion 42 and is joined to the connecting portion 49 at generally a right angle. The portion 47 is connected generally tangentially to the annular portion 42 and is connected at an obtuse angle to the connecting portion 49. The connecting portion 49 is disposed in contact with and below (as viewed in FIGS. 2 and 3) the support 39. As shown, the trapezoidal portion 44 receives the frame 11 as best shown in FIG. 3. A spacer 41 of such a configuration is especially useful in a print head having two (or more lines) because the printing bands 26 at the printing zone Z can be relatively close to each other. Also, in a two line print head, for example, the spacers 41 for one line can be identical in construction to the spacer or spacers for the other line as clearly shown in FIG. 3.

With reference to FIG. 6, one line is shown to have two sets S1 and S2 of printing bands 26 and the other line is shown to have three sets S1, S2 and S3 of printing bands 26. The one line is shown to have a thick spacer 41 and the other line is shown to have two thick spacers 41. Print head 10A according to FIG. 10 is shown to provide data in separate fields on a record R as shown in FIG. 7.

By way of example, not limitation, the spacer 41 is substantially thicker than the spacers 32. The spacers 32 are all of the same thickness. The spacer 41 is at least about five times thicker than a spacer 32 and more preferably between about ten and fourteen times thicker. The spacer 41 is preferably the same thickness as the width of a printing band 26. In one embodiment, the spacers 32 are planar and are about 0.005 inch thick and the spacer 41 is planar and is about 0.060 thick. The portions of the spacer 42 are shown to be relatively narrow. No part of the spacer 42 has a width W which is wider than one-half the diameter of the hole 43.

Figure 10:
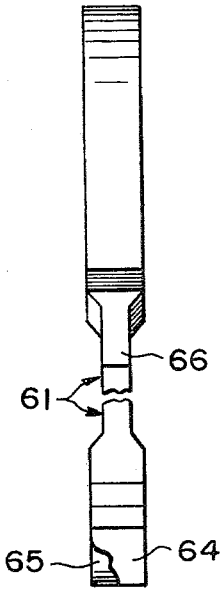
FIG. 10 is a broken-away view of a spacer according to the embodiment of FIGS. 8 and 9.
Figure 11:
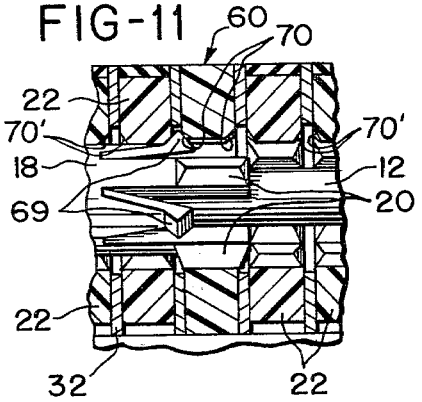
FIG. 11 is a sectional view taken along line 11—11 showing a tooth of the selector in guided contact with the spacer.
Figure 12:
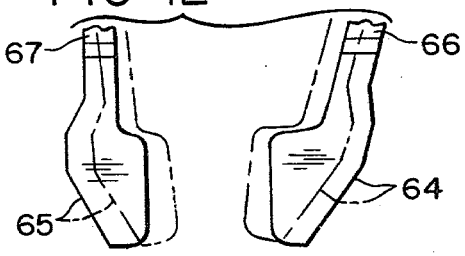
FIG. 12 is a fragmentary view of the end portions of the depending spacer members of the spacer in both phantom and full line positions.

With reference to the embodiment of FIGS. 8 through 12, there is shown the print head with the frames or supports 11, the concave mounting surfaces 38 and supporting surfaces 39. The improved spacers 60 are shown to have a pair of legs or spacer members 61 and 62 joined to a connecting portion or annular portion 63. The member 63 connects the spacer members 61 and 62. The spacer members 61 and 62 have respective free end portions 64 and 65. The free end portions 64 and 65 are of the same thickness and are equal in thickness to the annular portion 63. The spacer members 61 and 62 also have thin portions 66 and 67. Both sides of each thin portion 66 and 67 are shown spaced from the sides of the annular portion 63 and from the sides of the free end portions 64 and 65 as best shown in FIG. 10. The portions 63, 64 and 65 are shown to be coplanar. This minimizes the contact of the printing bands with the spacers 60. The only contact of the printing bands 26 and the intervening spacer 63 is where needed. The spacers 60 are of one-piece molded plastics construction. The spacer members 61 and 62 are molded so that the free end portions 64 and 65 are closer to each other than the thickness of the support 11. The spacer members 61 and 62 are sufficiently flexible and resilient to flex from the phantom line position shown in FIG. 12 to the solid line position shown in FIG. 12. The phantom line position is representative of the as-molded condition. The support 11 is thus straddled by and between the spacer members 61 and 62. The spacer members 61 and 62 thus hold onto the support 11 and prevent movement of the spacer 60 relative to the support 11.

Figure 8:
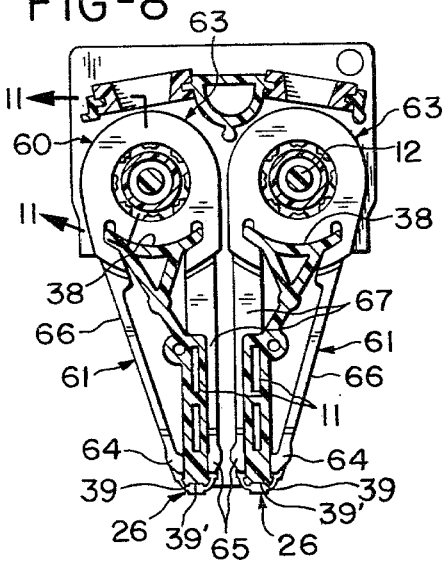
FIG. 8 is a view similar to FIG. 3, but showing an alternative embodiment.
Figure 9:
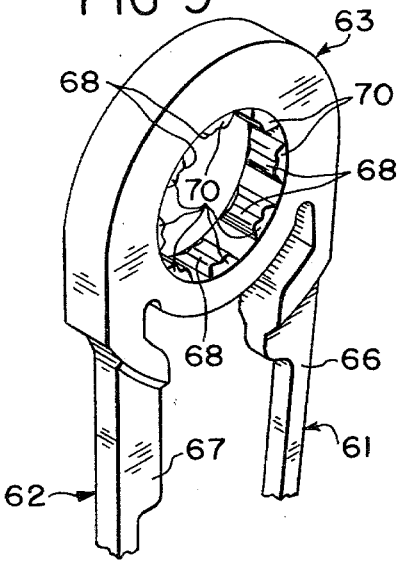
FIG. 9 is a fragmentary perspective view of one of the spacers shown in FIG. 8.

The annular or connecting portion 63 has teeth 68 disposed at regular intervals about its inner periphery. The teeth 68 are aligned with the teeth 21 when the printing band 26 is in its detented position as shown in FIG. 8. The band 26 is detented when a lug 26′ on the underside of a printing element is received in a notch 39′ in surface 39 as shown in FIG. 8. The teeth 20 on the selector 18 cooperate with the tooth 68 on the spacer 60 to provide smooth transition as the selector is moved from engagement with a drive wheel of one set 22 into engagement with a drive wheel of the adjacent set.

The selector 18 has a pair of flexible resilient detent fingers 69 which cooperate with the wheels 22 as disclosed in greater detail in U.S. Pat. No. 3,948,172. The spring detent fingers releasably hold the selector 18 in any selected position with its driving lug 20 engaged with a selected drive wheel 22. Both sides of the teeth 68 of the spacer 63 are beveled as indicated at 70 and both sides of the drive wheel teeth are beveled as indicated at 70′ so that the detent fingers 69 can be detented in the bevel between a wheel 22 and the spacer 60 or between the wheels 22. The selector 18 can be rotated to drive a selected drive wheel 22 to advance the respective printing band 26. As the selector 18 is shifted axially, the drive lug or member 20 engages the spacer 60 before the drive lug 20 disengages with an adjacent wheel 22, and the drive lug 20 engages an adjacent wheel 22 before the drive lug disengages with the spacer 60. The drive lug 20 is wide enough to span the bevels 70 or 70″.

Other embodiments and modifications of this invention will suggest themselves to those skilled in the art, and all such of these as come within the spirit of this invention are included within its scope as best defined by the appended claims.

I claim:

1. A print head, comprising: two spaced sets of axially aligned and rotatably mounted drive wheels, each drive wheel having a central hole, a series of teeth disposed at the inner periphery of the central hole of each wheel, a support having means providing a supporting surface, two spaced sets of printing bands received under tension about the supporting surface and the respective drive wheels of each set, each print band having a series of printing elements, means for detenting the printing bands so that the printing elements are registerable with a printing zone, a stationary non-printing spacer disposed between the sets of wheels, the spacer including an annular portion having a hole, a series of teeth disposed at the inner periphery of the spacer hole, the central holes and the spacer hole being axially aligned to provide an axially extending opening, the drive wheel teeth and the spacer teeth being aligned when the drive wheels are detented, the support being effective to support a printing element of each printing band at a printing zone, a rotatable and shiftable selector movable axially in the opening, the selector having teeth cooperable with the teeth of any drive wheel to rotate the selected drive wheel to advance the respective printing band, the teeth on the spacer being cooperable with the teeth of the selector to provide smooth transition of the selector from cooperation with the drive wheel teeth of one set to the drive wheel teeth of the adjacent set, the spacer further including a pair of depending spacer members joined to the annular portion, straddling the support and extending between adjacent sets of printing bands, each spacer member having a free end portion, the spacer being of one-piece molded plastics construction, the free end portions extending close to but terminating short of the supporting face, the spacer members being flexible and resilient, the spacing between the free end portions before assembly with the support being less than the thickness of the support so that when assembled the spacer members are spread slightly to resilient hold the spacer to the support.

2. A print head, comprising: two spaced sets of axially aligned and rotatably mounted drive wheels, each drive wheel having means defining a hole, a support having means providing a supporting surface, two spaced sets of printing bands received under tension about the supporting surface and the respective drive wheels of each set, each printing band having a series of printing elements, means for detenting the printing bands so that the printing elements are registerable with a printing zone, a stationary non-printing spacer disposed between the sets of wheels, the spacer having means defining a hole, the holes in the drive wheels and the hole in the spacer being axially aligned to provide an opening, the support being effective to support a printing element of each printing band at a printing zone, a rotatable and shiftable selector movable axially in the opening and adapted to pass through the spacer, the selector having means cooperable with any drive wheel to rotate the selected drive wheel to advance the respective printing band, the spacer including a pair of joined spacer members straddling the support and extending between adjacent sets of printing bands, each spacer member having a free end portion, the spacer members being flexible and resilient, the spacing between the free end portions before assembly with the support being less than the thickness of the support so that when assembled the spacer members are spread slightly to resiliently hold the spacer to the support.

3. A print head, comprising: two spaced sets of axially aligned and rotatably mounted drive wheels, each drive wheel having a central hole, a series of teeth disposed at the inner periphery of the central hole of each wheel, a support having means providing a supporting surface, two spaced sets of printing bands received under tension about the supporting surface and the respective drive wheels of each set, each printing band having a series of printing elements, means for detenting the printing bands so that the printing elements are registerable with a printing zone, a stationary non-printing spacer disposed between the sets of wheels, the spacer including an annular portion having a hole, a series of teeth disposed at the inner periphery of the spacer hole, the central holes and the spacer hole being axially aligned to provide an axially extending opening, the drive wheel teeth and the spacer teeth being aligned when the drive wheels are detented, the support being effective to support a printing element of each printing band at a printing zone, a rotatable and shiftable selector movable axially in the opening, the selector having teeth cooperable with the teeth of any drive wheel to rotate the selected drive wheel to advance the respective printing band, the teeth on the spacer being cooperable with the teeth of the selector to provide smooth transition of the selector from cooperation with the drive wheel teeth of one set to the drive wheel teeth of the adjacent set, the spacer further including a pair of depending spacer members joined to the annular portion, straddling the support and extending between adjacent sets of printing bands, each spacer member having a free end portion and a thin portion spaced inwardly from the sides of the annular portion and from the free end portion to minimize contact of the printing bands with the spacer members, the spacer members being flexible and resilient, the spacing between the free end portions before assembly with the support being less than the thickness of the support so that when assembled the spacer members are spread slightly to resiliently hold the spacer to the support.

4. A print head as defined in claim 3, wherein the annular portion and the free end portion are approximately the same width as the width of a printing band.

5. A print head, comprising: two spaced sets of axially aligned and rotatably mounted drive wheels, each drive wheel having means defining a hole, each drive wheel having teeth at its hole, a support having means providing a supporting surface, two spaced sets of printing bands received under tension about the supporting surface and the respective drive wheels of each set, each printing band having a series of printing elements, means for detenting the printing bands so that the printing elements are registerable with a printing zone, a stationary non-printing spacer disposed between the sets of wheels, the spacer having means defining a hole, the spacer including a connecting portion, the holes in the drive wheels and the hole in the spacer being axially aligned to provide an axially extending opening, the support being effective to support a printing element of each printing band at a printing zone, a rotatable and shiftable selector movable axially in the opening and through the connecting portion, the selector having means cooperable with the teeth of any drive wheel to rotate the selected drive wheel to advance the respective printing head, the spacer further including a pair of depending spacer members joined to the connecting portion, straddling the support and extending between adjacent sets of printing bands, and the spacer being of one-piece molded plastics construction, each spacer member having a free end portion and a thin portion, the thin portion being joined to the connecting portion, the thin portion having at least one side spaced inwardly from the corresponding side of the connecting portion and the free end portion to minimize contact with an adjacent printing band.

6. A print head as defined in claim 5, wherein the connecting portion and the free end portions are coplanar.

7. A print head, comprising: two spaced sets of axially aligned and rotatably mounted drive wheels, each drive wheel having a central hole, a series of teeth disposed at the inner periphery of the central hole of each wheel, a support having means providing a supporting surface, two spaced sets of printing bands received under tension about the supporting surface and the respective drive wheels of each set, each print band having a series of printing elements, means for detenting the printing bands so that the printing elements are registerable with the printing zone, a stationary non-printing spacer disposed between the sets of wheels, the spacer including an annular portion having a hole, a series of teeth disposed at the inner periphery of the spacer hole, the central holes and the spacer hole being axially aligned to provide an axially extending opening, the drive wheel teeth and the spacer teeth being aligned when the drive wheels are detented, the support being effective to support a printing element of each printing band at a printing zone, a rotatable and shiftable selector movable axially in the opening, the selector having teeth cooperable with the teeth of any drive wheel to rotate the selected drive wheel to advance the respective printing band, the teeth on the selector being cooperable with the teeth of the spacer to provide smooth transition of the selector from cooperating with the drive wheel teeth of one set to the drive wheel teeth of the adjacent set, the spacer further including a pair of depending spacer members joined to the annular portion, straddling the support and extending between adjacent sets of printing bands, the spacer being of one-piece molded plastics construction, each spacer member having a free end portion and a thin portion, the thin portion being joined to the annular portion, the thin portion having at least one side spaced inwardly from the corresponding side of the annular portion and the free end portion to minimize contact with an adjacent printing band.

8. A print head, comprising: two spaced sets of axially aligned and rotatably mounted drive wheels, each drive wheel having a central hole, a support having a concave surface and means providing a supporting surface, two spaced sets of printing bands received under tension about the supporting surface and the respective drive wheels of each set, each printing band having a series of printing elements, means for detenting the printing bands so that the printing elements are registerable with the printing zone, a stationary non-printing spacer disposed between the sets of wheels, the spacer including an annular portion having a hole, the drive wheels being rotatably mounted on the concave surface and the annular portion being disposed adjacent the concave surface, the central holes and the spacer hole being axially aligned to provide an opening, the support being effective to support a printing element of each printing band at a printing zone, a rotatable and shiftable selector movable axially in the opening, the selector having means cooperable with any drive wheel to rotate the selected drive wheel to advance the respective printing band, the spacer further including a pair of depending spacer members joined to the annular portion, straddling the support and extending between adjacent sets of printing bands, each spacer member having a free end portion, the spacer being of one-piece molded plastics construction, the spacer members being flexible and resilient, the spacing between the free end portions before assembly with the support being less than the thickness of the support so that when assembled the spacer members are spread slightly to resiliently hold the spacer to the support.

9. A print head as defined in claim 8, wherein the support is of one-piece molded plastics construction.

10. A print head, comprising: two spaced sets of axially aligned and rotatably mounted drive wheels, each drive wheel having a central hole, a series of teeth disposed at the inner periphery of the central hole of each wheel, a support having means providing a supporting surface, two spaced sets of printing bands received under tension about the supporting surface and the respective drive wheels of each set, each print band having a series of printing elements, means for detenting the printing bands so that the printing elements are registerable with the printing zone, a stationary non-printing spacer disposed between the sets of wheels, the spacer including an annular portion having a hole, a series of teeth disposed at the inner periphery of the spacer hole, the central holes and the spacer hole being axially aligned to provide an opening, the support being effective to support a printing element of each printing band at a printing zone, a rotatable and shiftable selector movable axially in the opening, the selector having teeth cooperable with the teeth of any drive wheel to rotate the selected drive wheel to advance the respective printing band, the teeth on the selector being cooperable with the teeth of the spacer to provide smooth transition of the selector from cooperating with the drive wheel teeth of one set to the drive wheel teeth of the adjacent set, the drive wheel teeth and the spacer teeth being aligned when the drive wheels are detented, the selector having means cooperable with the spacer and an adjacnet wheel for detenting the selector in any position in which the selector teeth are in driving cooperation with a selected drive wheel, the spacer further including a pair of depending spacer members joined to the annular portion, straddling the support and extending between adjacent sets of printing bands, and the spacer being of one-piece molded plastics construction.

11. A print head as defined in claim 10, wherein the detenting means includes a bevel in both sides of the spacer teeth and a bevel on both sides of each tooth of each drive wheel and the detenting means further includes resilient means cooperable with the bevels between adjacent wheels or between a said bevel on the spacer and a said bevel on an adjacent drive wheel.

12. A print head as defined in claim 11, wherein the detenting means includes a flexible resilient member coupled to the selector and cooperable with adjacent bevels.

13. A print head as defined in claim 12, wherein the selector teeth are wide enough to span the bevel on one side of the spacer and the bevel on the adjacent side of the adjacent drive wheel.

14. A print head as defined in claim 11, wherein the selector teeth are wide enough to span the bevel on one side of the spacer and the bevel on the adjacent side of the adjacent drive wheel.

* * * * *

UNITED STATES PATENT AND TRADEMARK OFFICE

CERTIFICATE OF CORRECTION

PATENT NO. : 4,334,470

DATED : June 15, 1982

INVENTOR(S) : Paul H. Hamisch, Jr.

It is certified that error appears in the above-identified patent and that said Letters Patent are hereby corrected as shown below:

Column 2, line 57, "sheel" should be --wheel--. Column 3, line 13, "had" should be --has--. Column 4, line 37, "tooth" should be --teeth--; line 59, "70" " should be --70'--. Column 5, line 31, "face" should be --surface--.

Signed and Sealed this

*Fifth* Day of *October 1982*

[SEAL]

*Attest:*

GERALD J. MOSSINGHOFF

*Attesting Officer*

*Commissioner of Patents and Trademarks*